United States Patent [19]

Young

[11] Patent Number: 4,757,571

[45] Date of Patent: Jul. 19, 1988

[54] FINGER AND NAIL BRUSH

[76] Inventor: Sidney F. Young, 6333 N. 37th Ave., Phoenix, Ariz. 85019

[21] Appl. No.: 853,651

[22] Filed: Apr. 18, 1986

[51] Int. Cl.[4] ..... A46B 9/02

[52] U.S. Cl. ..... 15/167.3; 15/106; 51/391; 128/355; 132/76.4

[58] Field of Search ..... 15/106, 111, 160, 167.3 B; 132/76.4, 76.5; 128/355; 51/391, 392, 393

[56] References Cited

U.S. PATENT DOCUMENTS

| | | | |
|---|---|---|---|
| 587,243 | 7/1897 | Sloan | 132/75.6 |
| 1,924,337 | 8/1933 | Troupa | 15/188 |
| 2,186,005 | 1/1940 | Casto | 15/167.1 |
| 2,464,321 | 3/1949 | Konczal | 15/167.1 |
| 2,695,416 | 11/1954 | Raimo | 15/106 |
| 3,354,492 | 11/1967 | Baumgartner | 15/167 B |
| 3,681,806 | 8/1972 | Han | 128/355 X |
| 3,744,078 | 7/1973 | Vallis | 15/167.3 |
| 3,843,991 | 10/1974 | Vallis | 15/167.3 |
| 4,050,825 | 9/1977 | Stein | 15/106 X |

FOREIGN PATENT DOCUMENTS

| | | | |
|---|---|---|---|
| 249610 | 4/1948 | Switzerland | 15/167 B |
| 5223 | of 1912 | United Kingdom | 15/167 B |
| 678406 | 9/1952 | United Kingdom | 15/167 B |

*Primary Examiner*—Peter Feldman

*Attorney, Agent, or Firm*—Charles E. Cates

[57] ABSTRACT

The specification teaches a method of applying contact lenses to human eyes by sensitizing the fingers and applying the lenses to the eyes by sense of touch. Also taught are several preferred embodiments of means for sensitizing and cleaning the fingers without liquid or cleansing chemical, wherein a base having two faces provided with abrasion means, e.g., brush bristles or nylon fiber pod, preferably trough shaped and with means for gripping the base, are provided.

6 Claims, 1 Drawing Sheet

FINGER AND NAIL BRUSH

This invention relates to a method of inserting a contact lens in the human eye and to an improved article of manufacture useful in the method.

Continuing problems in the use of contact lenses are the wearer's tendency to do an inadequate job of cleaning the lenses (because of the exacting standards of cleanliness required in the process of cleaning the lenses especially when cleaning and insertion are attempted in locations outside the home where ideal conditions are not present), and the difficulty in applying the lenses to the eyes.

BRIEF SUMMARY OF THE INVENTION

I have discovered that two related objectives can be attained by means of the method of this invention by using the step of sensitizing the wearer's fingers, particularly in conjunction with the use of the article of manufacture which is also the subject of this specification.

In the method, according to a presently preferred embodiment, the contact lens wearer augments the sense of touch through the fingers by abrading them by any suitable means and applying the lenses using the wearer's sense of touch, either solely if no mirror or other reflective means is available, or as a valuable aid to sight. Ideally, the fingers are washed conventionally with soap and water, but under emergency conditions washing facilities may not be available. In that event the abrasion provides a cleansing action without the use of liquid solvents or chemical cleaning agents by removing oils and dead skin from the finger.

The means for rubbing the fingers to increase sensitivity may take the form of set and mounted bristles (cut to size as in a brush) or a roughened surface analogous to sand paper. Presently preferred in a brush are short, stiff bristles wherein the brush surface defines a trough to better engage the entire finger tip pads. This may be best achieved by forming the brush base in the shape of the trough desired wherein the bristles of equal length are embedded so that each bristle has the same value. Thus the sensitivity produced in the fingers by the brushing action should be equal.

A finger and nail brush as shown in FIGS. 2 and 4 of the drawing has a four sided block base, trough shaped faces on two opposing sides, cooperating slip resistant surface and ramps arrangements on the remaining third and fourth opposing sides, and equal length, short bristles set in the troughed surfaces. Alternatively, flat surfaces on first and second opposing sides are set with bristles cut to define a trough shaped bristle surface. Relief apertures through the body extend from the third side to the fourth side.

BRIEF DESCRIPTION OF THE DRAWINGS

Turning now to the drawings in which the presently preferred embodiments of the invention are depicted.

DETAILED DESCRIPTION OF THE PREFERRED EMBODIMENT

Figure 1:
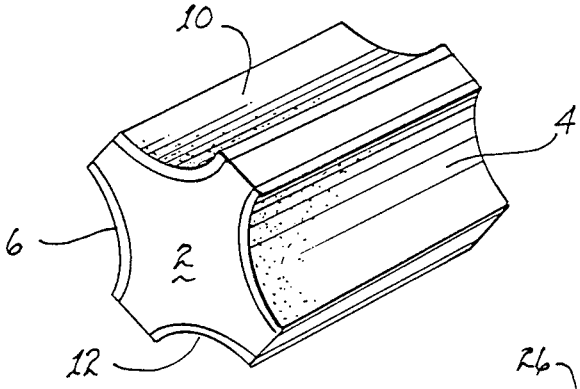
FIG. 1 is a perspective view of a first preferred embodiment.
Figure 5:
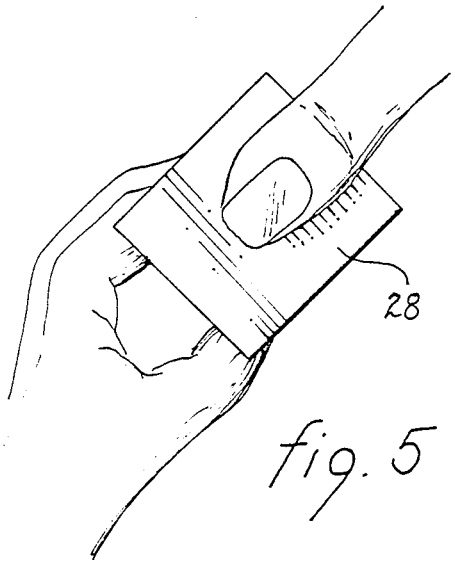
FIG. 5 shows the position of thumb and opposed finger in the use of the article.

Turning now to the drawings in which several presently preferred embodiments of the invention in an article of manufacture are depicted, a first preferred embodiment is shown in FIG. 1 wherein a base 2 formed in the shape of an X (viewed in cross section) is provided on two opposed faces 4 and 6 with an abrasive layer of material 8 herein nylon fiber, such as Scotch Brite brand. This material is also available from DuPont. The faces 10 and 12 are provided with a similar rough surfaced material for the purpose of providing a gripping surface which can be engaged by the thumb and an opposing finger of the user as indicated in FIG. 5.

In use, the article of manufacture is held by the gripping surfaces 10,12 with the fingers. The fingers that will be used to apply the lenses are abraded by surfaces 4 and 6 which action serves not only to sensitize the fingers but also to remove oil and dead skin present on the fingers, either one of which can contaminate the surfaces of the lenses and cause deterioration of the lens material.

Figure 2:
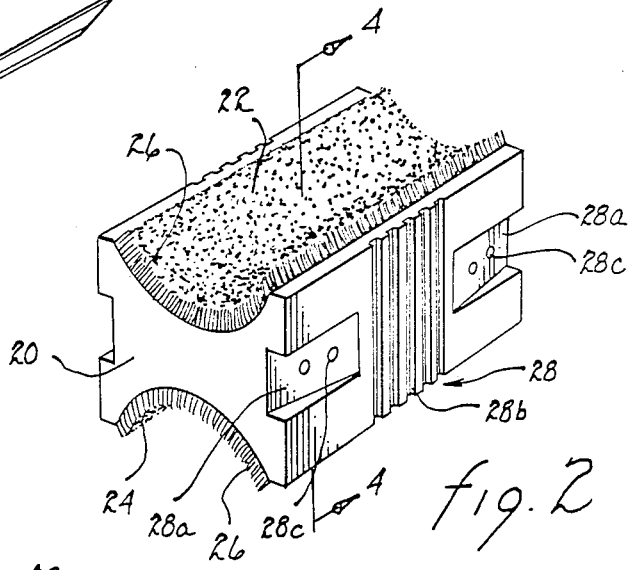
FIG. 2 is a perspective view of a second preferred embodiment.
Figure 4:
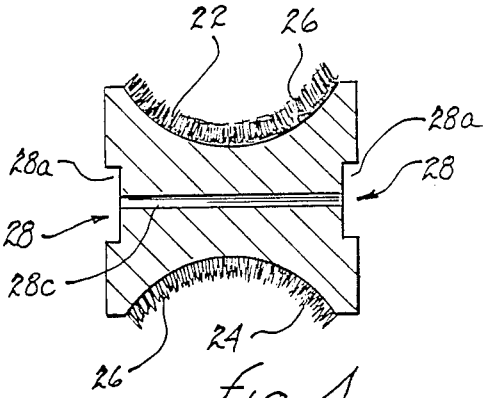
FIG. 4 is a cross section of FIG. 2 taken along the lines 4—4.

A second preferred embodiment is shown in FIGS. 2 and 4 wherein a four sided block base 20 is shaped to define troughs 22, 24 in two first and second opposing sides. Bristles 26 are set into the faces of troughs 22, 24 by means which are known to those skilled in the art of making brushes and which need not be set out in detail for that reason. The block 20, as shown in the embodiment of FIGS. 2 and 4, is shaped to define a cooperating ramp 28*a* and ridge 28*b* arrangement 28 on third and fourth opposing sides to better engage the rounded pads of an opposed finger and thumb. The apertures 28*c* are provided to assist in manufacturing and prevent surface deformation.

Figure 3:
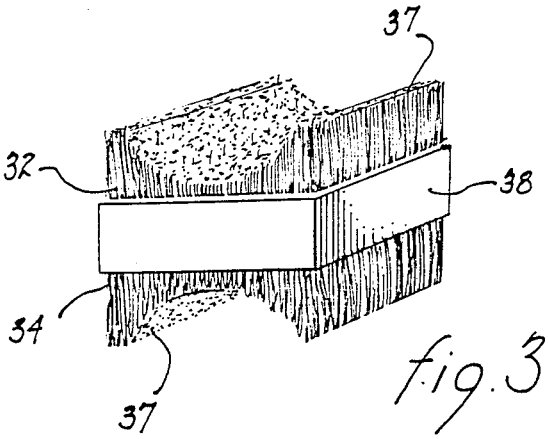
FIG. 3 is a perspective view of a third preferred embodiment.

In FIG. 3 yet another, less preferred embodiment is shown. Here the block base 30 has two flat faces, 32,34 in which bristles 36 are inserted. The bristle ends 37 are cropped to define the desired trough shape.

In each case in FIGS. 1 to 5 the base is provided with frictional gripping means indicated in said Figs. as 10, 12, (Fig.1), 28 (FIGS. 2,4) and 38 (FIG. 3).

Figure 6:
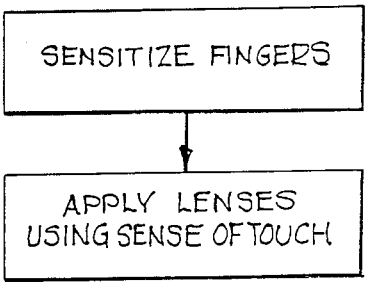
FIG. 6 is a schematic showing the basic steps of the process.

As indicated in FIG. 6, in operation the person applying the lenses sensitizes his fingers 40 and applies the lenses using the sense of touch 41, preferably using one of the articles of manufacture shown in FIGS. 1-5.

The embodiments shown are illustrative of the scope of the invention. From a consideration of this disclosure persons skilled in the art may readily see equivalent structures and embodiments that are within the spirit and scope of the invention.

What is claimed is:

1. A finger and nail brush comprising:

a. a block base having first and second opposing sides and third and fourth opposing sides;

b. means defining troughs in said first and second opposing sides;

c. bristles set into said first and second opposing sides;

d. means defining a pair of cooperating ramps and a slip resistant surface on each of said opposing third and fourth sides; wherein each of said pair of ramps slope inwardly from the surface of each of said third and fourth opposing sides from said slip resistant surface area to the end of each of said sides.

2. The brush of claim 1 wherein said slip resistant surface means comprises ridges formed in said third and fourth sides.

3. The finger and nail brush of claim 1 with the addition of apertures extending through said block base from said third to said fourth sides.

4. A finger and nail brush comprising:

a. a base having first and second opposing sides and third and fourth opposing sides;

b. bristles set into said first and second opposing sides;

c. said bristles cut to lengths defining a trough in each set of bristles on said first and second opposing sides;

d. means defining a pair of cooperating ramps and a slip resistant surface on each of said opposing third and fourth sides; wherein each of said pair of ramps slope inwardly from the surface of each of said third and fourth opposing sides from said slip resistant surface area to the end of each of said sides.

5. The brush of claim 4 wherein said slip resistant surface means comprises ridges formed in said third and fourth sides.

6. The finger and nail brush of claim 4 with the addition of apertues extending through said block base from said third to said fourth sides.

* * * * *